US010499134B1

(12) United States Patent
Patten

(10) Patent No.: US 10,499,134 B1
(45) Date of Patent: Dec. 3, 2019

(54) MULTIFUNCTIONAL EAR BUDS

(71) Applicant: Jonathan Patten, Seattle, WA (US)

(72) Inventor: Jonathan Patten, Seattle, WA (US)

( * ) Notice: Subject to any disclaimer, the term of this patent is extended or adjusted under 35 U.S.C. 154(b) by 0 days.

(21) Appl. No.: 15/709,724

(22) Filed: Sep. 20, 2017

(51) Int. Cl.
*H04R 1/10* (2006.01)

(52) U.S. Cl.
CPC ..... *H04R 1/1041* (2013.01); *H04R 1/1016* (2013.01); *H04R 1/1083* (2013.01); *H04R 2420/07* (2013.01)

(58) Field of Classification Search
CPC .. H04R 1/1041; H04R 1/1083; H04R 1/1016; H04R 2420/07; H04R 1/1066; H04R 5/0335
See application file for complete search history.

(56) References Cited

U.S. PATENT DOCUMENTS 8,652,062 B1 * 2/2014 Holder ..... A61B 5/7405 600/508
9,462,369 B2 * 10/2016 Kalhok ..... H04R 1/1041
10,225,640 B2 * 3/2019 Honeycutt ..... G06F 3/167
2005/0160270 A1 * 7/2005 Goldberg ..... G10H 1/0025 713/176
2007/0081690 A1 * 4/2007 Stagni ..... H04R 1/028 381/384
2008/0161023 A1 * 7/2008 Ko ..... A44C 15/0015 455/462
2014/0037102 A1 * 2/2014 Alanis ..... H04R 1/1041 381/74
2015/0146908 A1 * 5/2015 Kalhok ..... H04R 1/1041 381/374
2015/0230019 A1 * 8/2015 Sakai ..... H04R 1/1041 381/74
2016/0345087 A1 * 11/2016 Cox ..... H04R 1/04
2016/0353193 A1 * 12/2016 Williams ..... H04R 1/1033
2017/0111677 A1 * 4/2017 Wassingbo ..... H04N 21/2387
2017/0112240 A1 * 4/2017 Lee ..... A44C 15/003
2017/0123504 A1 * 5/2017 Kim ..... H04N 13/0014
2017/0227793 A1 * 8/2017 Abreu ..... G02C 11/10
2017/0289155 A1 * 10/2017 Kerai ..... H04L 63/0876
2017/0289668 A1 * 10/2017 Kim ..... H04R 1/1041
2017/0311073 A1 * 10/2017 Kang ..... G01R 33/02
2018/0014110 A1 * 1/2018 Ushakov ..... H04R 1/1066
2018/0367899 A1 * 12/2018 Lee ..... H01Q 9/285

* cited by examiner

*Primary Examiner* — Mohammad K Islam
(74) *Attorney, Agent, or Firm* — McLean Law LLC; Kimberly McLean, Esq.

(57) ABSTRACT

A multi-functional earbud including: a first earbud; a second earbud; a necklace; a first connector connecting the first earbud to the necklace; a second connector connecting the second earbud to the necklace; an earbud controller, where the earbud controller is incorporated into the necklace. The earbud controller includes two control buttons, where control buttons include a first button adapted to engage a phone through a Bluetooth connection. The control buttons also include a second control button, wherein the second control button controls volume, fade and sound reception. The second control button is arranged with the sound reception control at the center surrounded by four pads.

1 Claim, 2 Drawing Sheets

MULTIFUNCTIONAL EAR BUDS

BACKGROUND OF THE INVENTION

Field of Invention

The present invention relates to a multifunctional ear bud that include various control parameters.

Description of Related Art

Ear buds are commonly used to listen to music or to converse on a cellular phone. Ear buds come in various forms and sizes and some are specifically geared toward certain purposes such as use during physical activity. Ear buds are either wired directly to an electronic device or wirelessly communicate with the electronic device through a Bluetooth connection. One drawback to using ear buds is the inability or requirement that a user remove the ear buds interact with another individual. Normally, when the ear buds are within the ears the user must cut the sound from the electronic device and then remove the ear buds in order to interact with the individual. It can be dangerous to go jogging or walking while wearing ear buds outside if the user cannot hear the sounds around them. By being able to adjust both the volume of ambient noise and the sound coming through the ear buds, the user has significantly greater control of their environment and will be more likely able to find a safe setting for exercising with them. As a result, it would be advantageous to have a control system integrated within the ear buds to effectively hear ambient sound and then also provide further controls related to the use of the ear buds.

SUMMARY OF THE INVENTION

The present invention relates to a multi-functional earbud including: a first earbud; a second earbud; a necklace; a first connector connecting the first earbud to the necklace; a second connector connecting the second earbud to the necklace; an earbud controller, where the earbud controller is incorporated into the necklace. The earbud controller includes two control buttons, where control buttons include a first button adapted to engage and disengage a phone through a Bluetooth connection. The control buttons also include a second control button, wherein the second control button controls volume, fade and sound reception. The second control button is arranged with the sound reception control at the center surrounded by four pads.

DETAILED DESCRIPTION

The present invention relates to an ear bud system that is integrated within a necklace that includes a control button to control functions related to the use of ear buds. The ear buds are connected to the necklace through a wire connection and an opening is provided to place the necklace around the user's neck. At the distal end of the necklace is a controller that includes at least two control buttons. One button is adapted for activating a call with a cellular phone and the second provides volume, fade and mic control related to the use of the ear buds.

Figure 1:
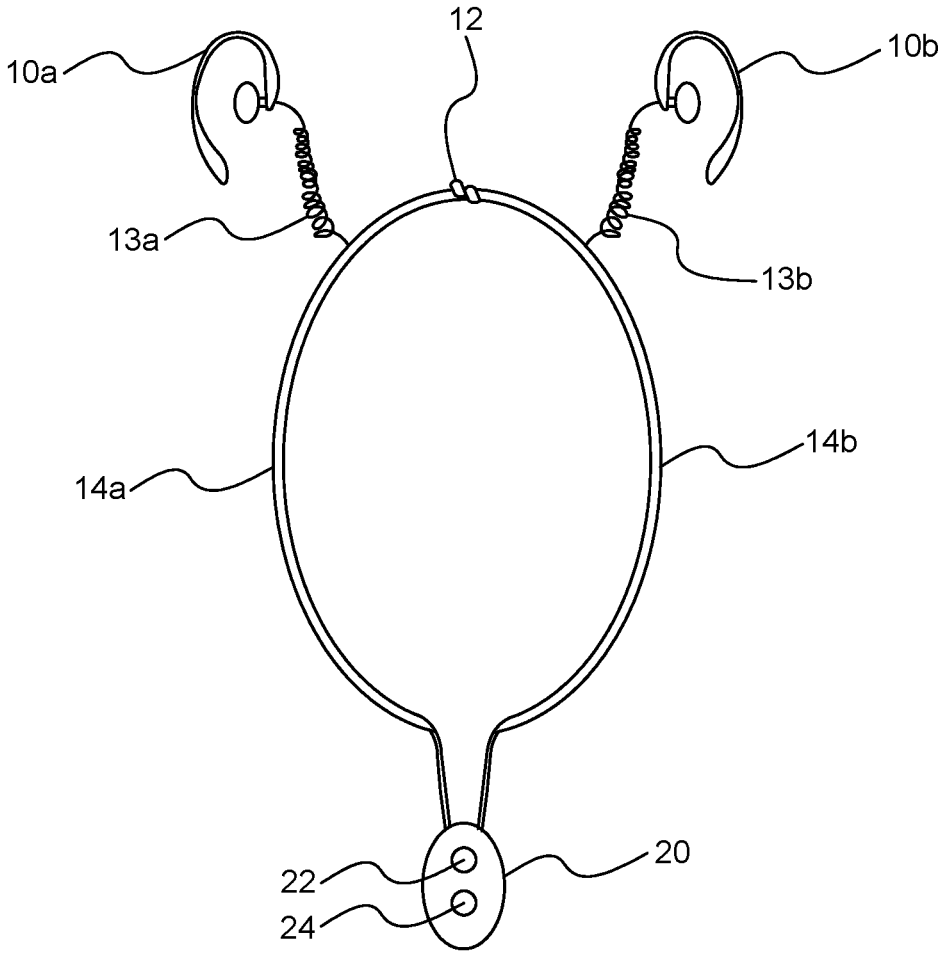
FIG. 1 depicts ear buds and necklace used in conjunction with the present invention.

In reference to FIG. 1, ear buds 10*a*, 10*b* are connected to a necklace 14. The necklace 14 has two sides, side 14*a*, 14*b*. At the distal end of the necklace 14 is a controller 20. An opening 12 is provided to enable placement of the necklace 14 around the user's neck, where the opening 12 may include a clip to secure the necklace 14 around a user's neck. A single ear bud is placed on each respective side 14*a*, 14*b* of the necklace 14. A first connector 13*a* connects ear bud 10*a* to the necklace 14 on side 14*a*. A second connector 13*b* connects ear bud 10*b* to side 14*b* of the necklace 14.

With respect to the controller 20, controller 20 includes a first control button 22 and a second control button 24. The control button 22 is depressed to either activate or answer a call that is incoming into a linked cellular phone or deactivate or disconnect from a call that is in progress. This enables the user to use the ear buds to hear audio from the cellular phone and a mic is provided on the controller 20 to transmit the user's conversation to the phone. The connection between the ear buds 10*a*, 10*b* and a cellular phone is preferably through the controller 20, where a Bluetooth connection provides a communication link between the controller 20 and the cellular phone. Although ear buds 10*a*, 10*b* are shown as the preferred embodiment, the present invention may also be implemented by using headphones connected to the necklace 14. The communication connection between the controller 20 and ear buds 10*a*, 10*b* may be accomplished through a direct connection through connectors 13*a*, 13*b* or alternatively through a second Bluetooth connection.

Figure 2:
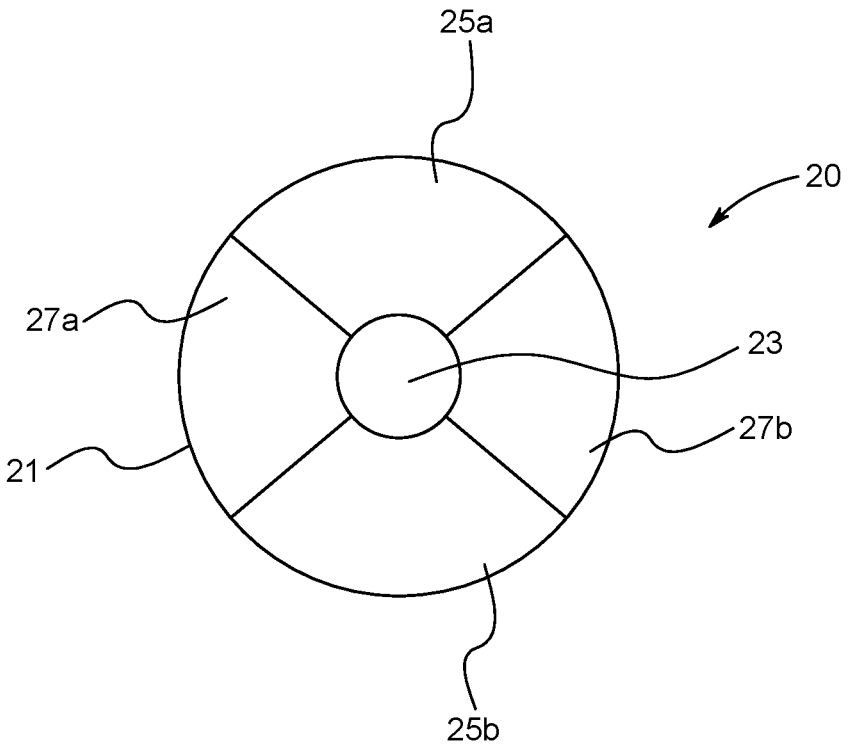
FIG. 2 depicts a close-up view of one of the control buttons used in conjunction with the present invention.

The controller 20 further includes a second control button 24. The second control button 24 includes various control aspects of the ear buds and use in conjunction with the cellular phone. FIG. 2 depicts a close-up view of the second control button 24. As shown, a small center toggle switch 23 is shown that is surrounded by four pads. Each pad provides a different control aspect. Pads 25*a*, 25*b* control volume and Pads 27*a*, 27*b* provides a fade feature controlling the fade aspects of the audio provided through the ear buds 10*a*, 10*b*. Center Toggle Switch 23 toggles the audio and microphone associated with the ear buds 10*a*, 10*b*. Three cycles are provided so that a user may cycle through three settings related to the ear buds. The first cycle is the default cycle, which streams audio directly to the ear buds and cancels out any ambient noise or audio. A second cycle provides continues streaming of the audio from the cellular phone but open a connection to ambient noise or sounds. A third cycle provides the user with only ambient sounds therefore allowing a user to toggle through these cycles as desired during use.

As shown in FIG. 1, a first side of the controller 20 is shown. This first side includes the first control button 22 and the second control button 24. A second side of the controller 20 is preferably a blank flat surface. This second side may be adapted to accommodate a decorative faceplate. In this particular embodiment, controller 20 may include notches to receive the faceplate and the controller 20 is worn with the control buttons 22, 24 facing rearward and the second side with the faceplate facing forward.

The present invention provides sufficient control features to enable a user to effectively use ear buds in various aspects to allow the entry of ambient noise and then also to cancel ambient noise as desired. The foregoing descriptions of specific embodiments of the present invention have been presented for purposes of illustration and description. They are not intended to be exhaustive or to limit the invention to the precise forms disclosed, and obviously, many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. A multi-functional earbud comprising:

a first earbud;

a second earbud;

a necklace;

a first connector connecting the first earbud to the necklace;

a second connector connecting the second earbud to the necklace;

a first Bluetooth connection for providing a communication link between an earbud controller and a cellular phone;

a second Bluetooth connection for providing a communication link between the earbud controller and the first and second earbuds; and an earbud controller integrated within the necklace, the earbud controller including a first control button that operates to answer a call that is incoming from a linked cellular phone or to disconnect from a call that is in progress, and a second control button that includes a pair of pads for controlling the volume of the audio through the first and second earbuds, another pair of pads for controlling fade aspects of the audio through the first and second earbuds, and a switch for toggling the audio and microphone by switching between a first default operating setting for the first and second earbuds, which streams audio directly to the earbuds and cancels out any ambient noise or audio, a second operating setting for the first and second earbuds, which streams audio directly to the earbuds along with ambient noise or sounds, and a third operating setting for the first and second earbuds, which only provides ambient sound to the ear buds.

* * * * *